US008570223B2

(12) United States Patent
Arslan et al.

(10) Patent No.: US 8,570,223 B2
(45) Date of Patent: Oct. 29, 2013

(54) RECONFIGURABLE ANTENNA

(75) Inventors: Tughrul Arslan, Edinburgh (GB); Anthony John Walton, Edinburgh (GB); Nakul R. Haridas, Edinburgh (GB); Ahmed Osman El-Rayis, Edinburgh (GB)

(73) Assignee: The University Court of the University of Edinburgh, Edinburgh (GB)

( * ) Notice: Subject to any disclaimer, the term of this patent is extended or adjusted under 35 U.S.C. 154(b) by 644 days.

(21) Appl. No.: 12/663,803

(22) PCT Filed: Jun. 13, 2008

(86) PCT No.: PCT/GB2008/050448

§ 371 (c)(1),
(2), (4) Date: Jul. 7, 2010

(87) PCT Pub. No.: WO2008/152428

PCT Pub. Date: Dec. 18, 2008

(65) Prior Publication Data

US 2010/0289717 A1 Nov. 18, 2010

Related U.S. Application Data

(60) Provisional application No. 60/934,401, filed on Jun. 13, 2007.

(30) Foreign Application Priority Data

Jun. 13, 2007 (GB) ..... 0711382.2

(51) Int. Cl.
*H01Q 1/38* (2006.01)

(52) U.S. Cl.
USPC ..... 343/700 MS; 343/876

(58) Field of Classification Search
USPC ..... 343/876, 700 MS
See application file for complete search history.

(56) References Cited

U.S. PATENT DOCUMENTS 6,154,176 A * 11/2000 Fathy et al. ..... 343/700 MS
6,417,807 B1 * 7/2002 Hsu et al. ..... 343/700 MS (Continued)

FOREIGN PATENT DOCUMENTS

EP 1 429 413 A1 6/2004
EP 1 717 903 A1 11/2006

(Continued)

OTHER PUBLICATIONS

Japanese Examination Report (dated Oct. 24, 2012) for corresponding Japanese Application No. 2010-511732.
Haridas, et al., Adaptive Micro-Antenna on Silicon Substrate,: Adaptive Hardware and Systems, XP010920164, pp. 43-50 (2006).

*Primary Examiner* — Jason M Crawford
(74) *Attorney, Agent, or Firm* — Edwards Wildman Palmer LLP; Scott D. Wofsy; George N. Chaclas

(57) ABSTRACT

A micro electromechanical (MEMS) antenna (36) is positioned on one side of a substrate and is connected to a MEMS switch comprising a capacitor bridge (46) and to a transmission line (42) by means of a thru hole or via (48) which forms an electrically conducting path through the substrate. This arrangement provides a common ground plane for the antenna and switch and shields the switch from the electromagnetic radiation received or transmitted from the antenna. The switch may comprise a topmost metal layer which extends across a bridge structure formed by a polymer layer (19). The polymer layer comprises poly-monochloro-para-xylene (parylene-C). Homogeneous or heterogeneous antenna array structures are implemented. The antenna arrays may include one or more different type of antennas with for example different shapes, rotations and reflections.

46 Claims, 15 Drawing Sheets

(56) References Cited

U.S. PATENT DOCUMENTS

| | | | | |
|---|---|---|---|---|
| 6,469,677 | B1 * | 10/2002 | Schaffner et al. | 343/876 |
| 7,095,372 | B2 * | 8/2006 | Soler Castany et al. | 343/700 MS |
| 7,358,915 | B2 * | 4/2008 | Legay et al. | 343/768 |
| 8,102,638 | B2 * | 1/2012 | Arslan et al. | 361/281 |
| 2003/0020173 | A1 * | 1/2003 | Huff et al. | 257/774 |
| 2003/0058069 | A1 * | 3/2003 | Schwartz et al. | 335/78 |
| 2003/0184476 | A1 * | 10/2003 | Sikina et al. | 343/700 MS |
| 2004/0164915 | A1 | 8/2004 | Quan et al. | |
| 2004/0252059 | A1 | 12/2004 | Zaghloul et al. | |
| 2005/0062653 | A1 * | 3/2005 | Cetiner et al. | 343/701 |
| 2005/0068123 | A1 * | 3/2005 | DeNatale et al. | 333/161 |
| 2005/0237198 | A1 * | 10/2005 | Waldner et al. | 340/572.7 |
| 2006/0244672 | A1 * | 11/2006 | Avakian et al. | 343/785 |

FOREIGN PATENT DOCUMENTS

| | | | |
|---|---|---|---|
| JP | 2004-015179 | A | 1/2004 |
| JP | 2004-186575 | A | 7/2004 |
| JP | 2004-208275 | A | 7/2004 |
| JP | 2005-303690 | A | 10/2005 |
| JP | 2006-157129 | A | 6/2006 |
| JP | 2006-196974 | A | 7/2006 |
| JP | 2006-216258 | A | 8/2006 |
| JP | 2006-518968 | A | 8/2006 |
| JP | 2006-261374 | A | 9/2006 |
| JP | 2006-311566 | A | 11/2006 |
| JP | 2007-507984 | A | 3/2007 |
| WO | 2005034287 | | 4/2005 |
| WO | WO-2005/034287 | A1 | 4/2005 |

* cited by examiner

RECONFIGURABLE ANTENNA

This application is the U.S. National Phase, pursuant to 35 U.S.C. §371, of international application no. PCT/GB2008/050448, published in English on Dec. 18, 2008 as international publication no. WO 2008/152428 A1, which claims the benefit of British application Serial No. GB 0711382.2, filed Jun. 13, 2007 and U.S. Provisional Application No. 60/934,401, filed Jun. 13, 2007, the disclosure of which applications are incorporated herein in their entireties by this reference.

FIELD OF THE INVENTION

The present invention relates to a reconfigurable antenna for use in wireless communications which incorporates micro electromechanical (MEMS) components including a novel switch.

BACKGROUND TO THE INVENTION

Wireless communication systems which can dynamically adapt to constantly changing environmental propagation characteristics will be the key for the next generation of communication applications.

The antenna is an extremely important component in any wireless appliance because it transmits and receives radio waves. An antenna operates as a matching device from a transmission line to free space and vice versa. An ideal antenna radiates the entire power incident from the transmission line feeding the antenna from one or more predetermined direction. Performance of the antenna dictates performance of most wireless devices and hence is a critical part of the system.

Antenna configuration determines the antenna properties that include impedance and VSWR (Voltage Standing Wave Ratio), amplitude radiation patterns, 3 dB beamwidth, directivity, gain, polarization and bandwidth. Different antenna configurations have different antenna properties.

A reconfigurable antenna is one which alters its radiation, polarization and frequency characteristics by changing its physical structure. The reconfigurable antenna concept is fundamentally different from a smart antenna.

A smart or adaptive antenna is an antenna array of elements that are typically standard monopoles, dipoles or patches. A signal processor is used to manipulate the time domain signals from or to the individual antenna elements by weighting and combining elements of the signals to change the resulting radiation pattern, i.e. the spatial response of the array, satisfies some conditions. This is the key concept of beam forming through which electromagnetic energy is focused in the direction of the desired signal while a null is placed in the direction of noise or interference sources.

Patch Antennas consists of a metallic patch over a dielectric substrate that sits on a ground plane. The antenna is fed by a microstrip line or a coaxial cable line. A microstrip patch antenna is a resonant style radiator which has one of its dimensions approximately $\lambda_g/2$ where $\lambda_g$ is the guided wavelength.

The patch acts as a resonant cavity with an electric field perpendicular to the patch that is along its z direction. The magnetic cavity has vanishing tangential components at the four edges of the patch. The structure radiates from the fringing fields that are exposed above the substrate at the edges of the patch. A microstrip antenna can be fabricated in many shapes, for example, square, circular, elliptical, triangular, or annular.

Microstrip Patch Antennas have several well-know advantages over the other antenna structures, including their low profile and hence conformal nature, light weight, low cost of production, robust nature, and compatibility with microwave monolithic integrated circuits (MMIC) and optoelectronic integrated circuits (OEIC) technologies.

Micro-electro Mechanical Systems (MEMS) switches are devices that use mechanical movement to achieve a short circuit or an open circuit in the RF transmissions line. RF MEMS switches are specific micromechanical switches that are designed to operate at RF-to-millimeter-wave frequencies (0.1 to 100 GHz) and form the basic building blocks in the RF communication system. The forces required for the mechanical movement can be obtained, for example, but not exclusively using electrostatic, magneto static, piezoelectric, or thermal designs.

The advantages of MEMS switches over p-i-n-diode or FET switches are:

- Near-Zero Power Consumption: Electrostatic actuation does not consume any current, leading to very low power dissipation (10-100 nJ per switching cycle).
- Very High Isolation: RF MEMS series switches are fabricated with air gaps, and therefore, have very low off-state capacitances (2-4 fF) resulting in excellent isolation at 0.1-40 GHz.
- Very Low Insertion Loss: RF MEMS series and shunt switches have an insertion loss of −0.1 dB up to 40 GHz.
- Intermodulation Products: MEMS switches are very linear devices and, therefore, result in very low intermodulation products. Their performance is around 30 dB better than p-i-n or FET switches.
- Very Low Cost: RF MEMS switches are fabricated using surface (or bulk) micromachining techniques and can be built on quartz, Pyrex; low temperature cofired ceramic (LTCC), mechanical-grade high-resistivity silicon, or GaAs substrates.
- MEMS switched can be categorised as follows:
  - RF circuit configuration—series or parallel.
  - Mechanical structure—Cantilever or Air-bridge.
  - Form of Contact—Capacitive (metal-insulator-metal) Resistive (metal-metal).

FIGS. 1 and 2 show a typical MEMS capacitive switch 63 which consists of a thin metallic bridge 65 suspended over the transmission line 67 covered by dielectric film 69. The MEMS capacitive switch can be integrated in a coplanar waveguide (CPW) or in a Microstrip topology. Conventional capacitive switches have a layer of dielectric between the two metal layers (bridge and t-line).

In a CPW configuration, the anchors of the MEMS switch are connected to the CPW ground planes. As seen in FIG. 2, when a DC voltage is applied between the MEMS bridge and the microwave line there is an electrostatic (or other) force that causes the MEMS Bridge to deform on the dielectric layer, increasing the bridge capacitance by a factor of 30-100. This capacitance connects the t-line to the ground and acts a short circuit at microwave frequencies, resulting in a reflective switch. When the bias voltage is removed, the MEMS switch returns to its original position due to the restoring spring forces of the bridge.

RF MEMS switches are used in reconfigurable networks, antennas and subsystems because they have very low insertion loss and high Q up to 120 GHz. In addition, they can be integrated on low dielectric-constant substrates used in high performance tuneable filters, high efficiency antennas, and low loss matching networks.

RF MEMS switches offer very low loss switching and can be controlled using 10- to 120 kΩ resistive lines. This means that the bias network for RF MEMS switches will not interfere and degrade antenna radiation patterns. The Bias network will not consume any power and this is important for large antenna arrays.

The underlying mechanism is a compact MEMS cantilever switch that is arrayed in two dimensions. The switches within the array can be individually actuated. Addressability of the individual micro switches in the array provides the means to modify the circuit trace and therefore allows fine tuning or complete reconfiguration of the circuit element behaviour.

The typical MEMS switches require typical pull down voltages of 50-100V (these can be significantly lower or higher depending on the exact configuration and material system). This is a large range to cover using a software controlled DC MEMS Switch.

The University of California, Irvine has proposed the use of a pixel antenna concept having an array of individual antenna elements that can be connected via MEMS Switches. Frequency reconfigurability is achieved by simply changing the size of the Antenna. By selecting 25 pixels an upper operating frequency of 6.4 GHz is obtained, whereas a lower frequency of 4.1 GHz is obtained by selection of all 64 pixels.

It is an object of the present invention to provide an improved reconfigurable MEMS antenna.

SUMMARY OF THE INVENTION

In accordance with a first aspect of the invention there is provided an apparatus for transmitting and/or receiving electromagnetic waves, the apparatus comprising:

a substrate;

one or more antenna mounted on a first surface of the substrate;

one or more microelectromechanical (MEMS) switch positioned on a second surface of the substrate;

a connector extending through the substrate to operatively connect the MEMS switch to the antenna;

Preferably, the substrate comprises a semi-conductor layer and at least one insulating layer.

Preferably, the at least one insulating layer forms a substrate for the antenna.

Preferably, the substrate is adapted to shield the MEMS switch from the antenna.

Preferably, the MEMS switch and the antenna have a common ground.

Preferably the common ground comprises the semi-conductor layer.

Preferably, the antenna comprises a patterned metal surface.

Preferably, the patterned metal surface comprises a spiral.

Preferably, the spiral is curved.

Preferably, the antenna comprises a plurality of antenna elements.

Preferably, the antenna elements are connected.

Preferably, one or more of the antenna elements can be switched on or off.

Preferably, one or more of the antenna elements can be switched on or off to control the operating frequency of the apparatus.

Preferably, the MEMS switch is a capacitive switch.

Preferably, the MEMS switch operates to change the phase of the input to or output from the antenna.

Preferably, the MEMS switch comprises:

a substrate;

a first conducting layer;

a material attached to the substrate and forming a bridge structure on the substrate;

a second conducting layer attached to the surface of the material remote from the substrate;

wherein, the material acts as a mechanical support to the second conducting layer and as a dielectric.

Preferably, the material is adapted to bend in response to the application of a force thereby changing the capacitance of the MEMS switch.

Preferably, the material is adapted to bend in response to the application of a voltage across the first and second conducting layers thereby changing the capacitance of the MEMS switch.

Preferably, the material has a Young's Modulus of elasticity of less than 4.5 GPa.

Preferably, the material has a dielectric constant at 1 MHz of more than 2.

Preferably, the material is a polymer.

Preferably, the material is derived from para-xylylene.

More preferably, the material is poly-monochoro-para-xylylene.

Optionally, the material is poly-para-xylylene.

Preferably, the second conducting layer is a metal.

More preferably, the second conducting layer comprises Aluminium.

Preferably, the MEMS switch further comprises a co-planar waveguide mounted on the substrate.

Optionally, the MEMS switch is integrated in a microstrip topology.

Preferably, the bridge structure comprises a beam shaped to alter the mechanical properties of the bridge and the way in which it moves in response to the applied voltage.

Preferably, the beam is symmetrical.

Optionally, the beam is asymmetrical.

Preferably, the beam comprises a serpentine flexure.

Depending upon the shape of the beam, it may twist or bend in a predetermined manner upon the application of the voltage.

Preferably, the MEMS switch is used to connect and disconnect an electromagnetic device to a feed line or signal path.

Preferably, the MEMS switch is used to alter the phase of the signal on the feed line.

Preferably, the change in the phase with the applied voltage is substantially linear over a predetermined voltage range.

Preferably, a plurality of the MEMS switches can be combined to provide a controllable phase shift from 0 to 360° upon application of the applied voltage.

Preferably, the connector is a through hole or via.

Preferably, the connector comprises conducting material attached thereto.

Preferably, the apparatus further comprises an integrated circuit attached to the apparatus at or near the MEMS switch.

Preferably, the integrated circuit comprises a CMOS circuit.

Preferably, the CMOS circuit comprises a CMOS radio.

Preferably, the plurality of antenna elements comprises an antenna array comprising a plurality of first antenna elements each having a first antenna configuration and further comprising a plurality of second antenna elements each having a second antenna configuration wherein first antenna configuration and second antenna configuration are different.

Preferably, the second antenna configuration comprises a transformation of the first antenna configuration.

Preferably, the transformation comprises at least one of rotation, reflection, scaling and distortion.

Preferably, the plurality of first antenna elements is interleaved with the plurality of second antenna elements.

Preferably, the antenna array comprises a first element group comprising the first and second antenna elements and a second element group comprising a transformation of the first element group.

Preferably, the transformation comprises reflection.

According to a second aspect of the present invention, there is provided an apparatus for transmitting and/or receiving electromagnetic waves, the apparatus comprising:

an antenna array comprising a plurality of first antenna elements each having a first antenna configuration and further comprising a plurality of second antenna elements each having a second antenna configuration wherein first antenna configuration and second antenna configuration are different; and one or more switches operable to switch on or off one or more of the antenna elements so as to configure the antenna array.

Preferably, the second antenna configuration comprises a transformation of the first antenna configuration.

Preferably, the transformation comprises at least one of rotation, reflection, scaling and distortion.

Preferably, the plurality of first antenna elements is interleaved with the plurality of second antenna elements.

Preferably, the antenna array comprises a first element group comprising the first and second antenna elements and a second element group comprising a transformation of the first element group.

Preferably, the transformation comprises reflection.

BRIEF DESCRIPTION OF THE DRAWINGS

The invention will now be described by way of example only with reference to the accompanying drawings of which.

DETAILED DESCRIPTION OF THE DRAWINGS

Figure 3:
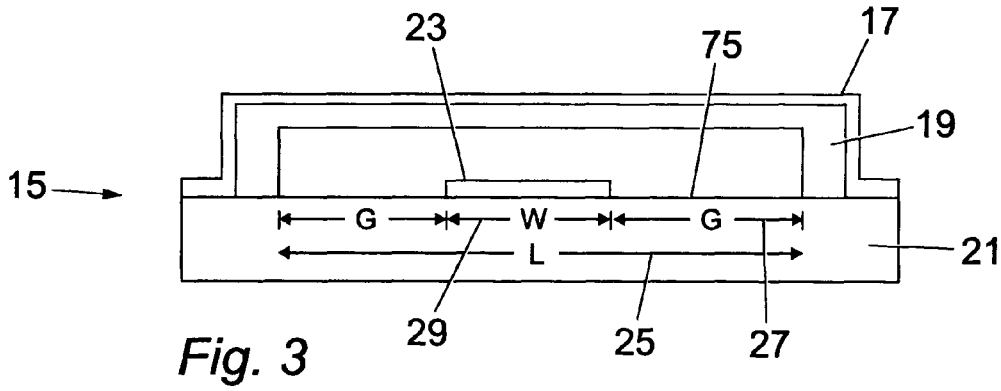
FIG. 3 shows a first embodiment of a device in accordance with the present invention.

FIG. 3 shows an embodiment of a device in accordance with the present invention. The device 15 comprises a topmost metal layer 17 which extends across a bridge structure formed by a polymer layer 19. The polymer layer comprises poly-monochoro-para-xylene (parylene-C).

The space below the polymer layer 19 contains a co-planar waveguide 23 and the second plate 75 on substrate 21. The overall supported distance L is provided by the distance W being the width of the coplanar wave guide and distances G which are equal and provide the remaining distance between the edges of the coplanar waveguide and the upright part of the polymer 19.

Parylene is generally used as a water proofing material in MEMS fabrication. It is a plastic like polymer with very low spring constant (i.e. high elasticity). Parylene-C was used in this embodiment of the present invention because it contained the appropriate degree of flexibility, dielectric strength and other properties associated with its normal use as a coating material. Parylene-C is a vacuum deposited plastic film that forms a polymer as a solid coating from a gaseous monomer. It provides excellent corrosion resistance, is light weight, stress free and radiation resistant making it suitable for space and military applications. Parylene-C has a Young's modulus of 2.8 GPa and is therefore an extremely flexible material that is able to bend with the deformation of the device upon application of a voltage.

Using Parylene as the primary bridge material makes the bridge of the MEMS device very flexible and requires a relatively low actuation voltage to pull the bridge down. This means that lower power is required to control the MEMS device. The use of Parylene allows the creation of a single element, dynamically configurable rf phase shifter for any particular calibrated frequency. An array of such phase shifter elements can be assembled and individually addressed, to vary the overall properties of an rf device. For example by attaching antenna elements to form a phased array either for operation at a fixed, or a reconfigurable range of frequencies.

Figure 1:
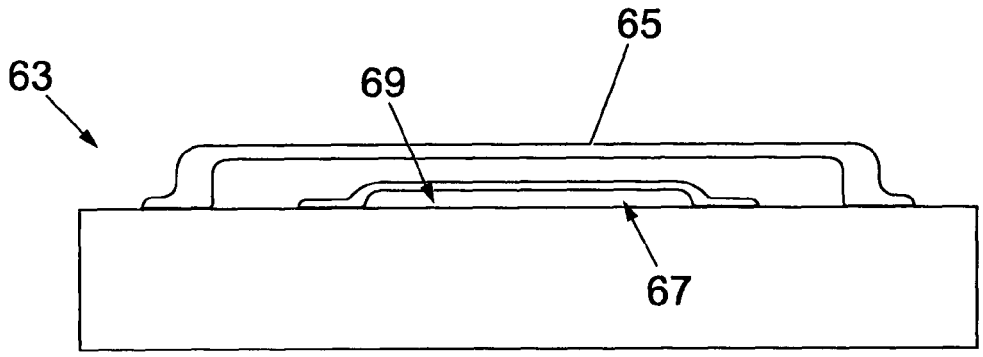
FIG. 1 is a diagram of a known MEMS capacitive bridge.
Figure 2:
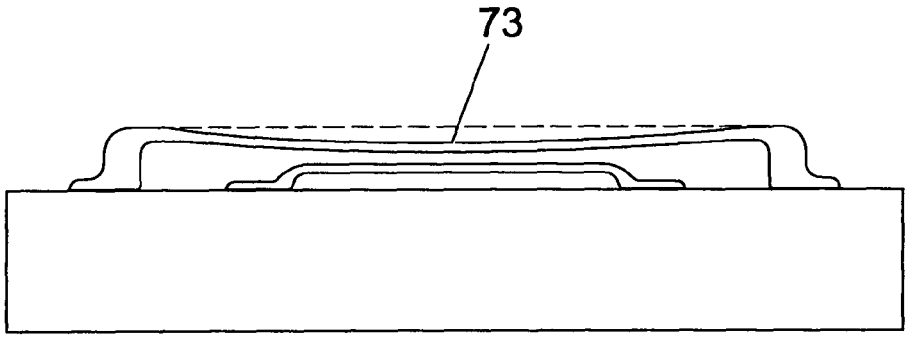
FIG. 2 is a diagram of a known MEMS capacitive bridge having a voltage applied thereto.

The use of Parylene provides the strength member of the bridge. Traditional MEMS bridges use a metal bridge and have an insulating layer on the bottom plate to provide the dielectric for the capacitive switch, shown in FIG. 1. Compared to the typical MEMS bridge, in the preferred embodiment of the present invention the insulation layer is moved from the bottom plate to the top plate. This provides an insulating layer between the two metal layers of the MEMS device and eliminates the need for the insulation over the metal track below. The preferred embodiment uses air as the variable dielectric and parylene as constant dielectric material, to change the capacitance by varying the bridge height. Choosing parylene as the primary material of the bridge also supports having very thin metal films as the top metal layer. This facilitates the fabrication of very flexible MEMS devices.

Figure 4:
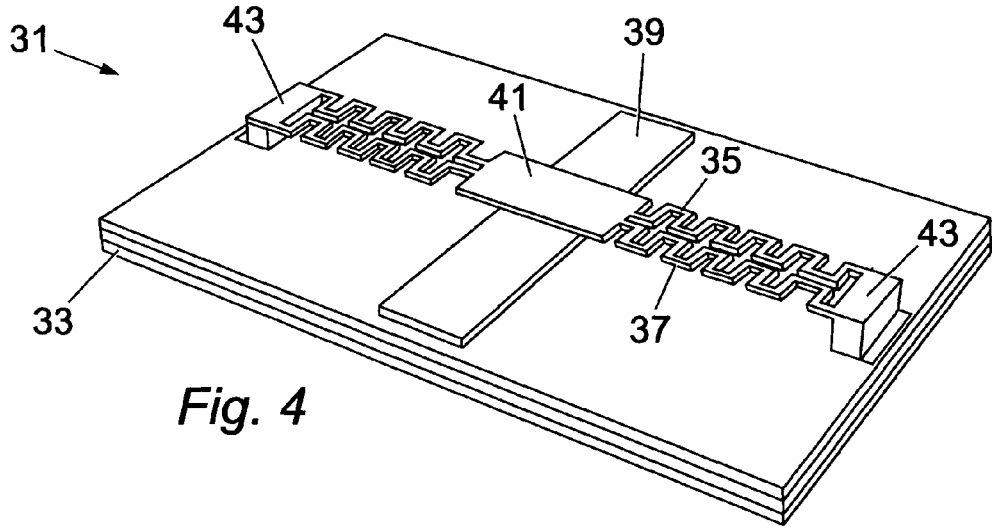
FIG. 4 shows a second embodiment of the device having a symmetrical serpentine support.

FIG. 4 shows a symmetric serpentine bridge design 31 comprising a substrate 33, serpentine flexures 35, 37 which extend along the length of the substrate to substantially bisect it. The serpentine flexures are supported in a raised position by supports 43. Solid plate 41 forms the central part of the beam and is attached to the serpentine flexures 35, 37 at either end thereof. CPW 39 is supported below plate 41 and is separated from the plate 41 by a gap.

Figure 5:
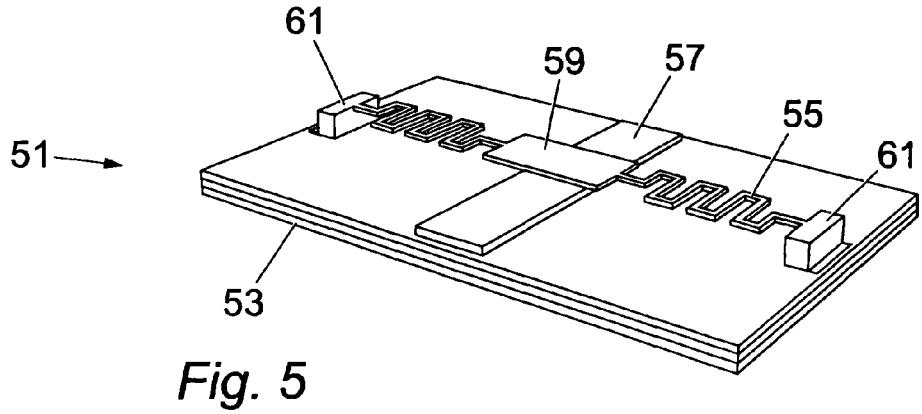
FIG. 5 shows a device similar to that of FIG. 4 but having an asymmetrical serpentine support.

FIG. 5 shows another embodiment of a switch of similar construction to that of FIG. 4. It comprises a substrate 53, a serpentine beam 55, a CPW 57, a plate 59 and supports 61. The asymmetric structure can cause the bridge to twist upon application of a voltage. Other beam and flexure geometries are envisaged where the application of a voltage could move the beam in a controllable manner.

Figure 6:
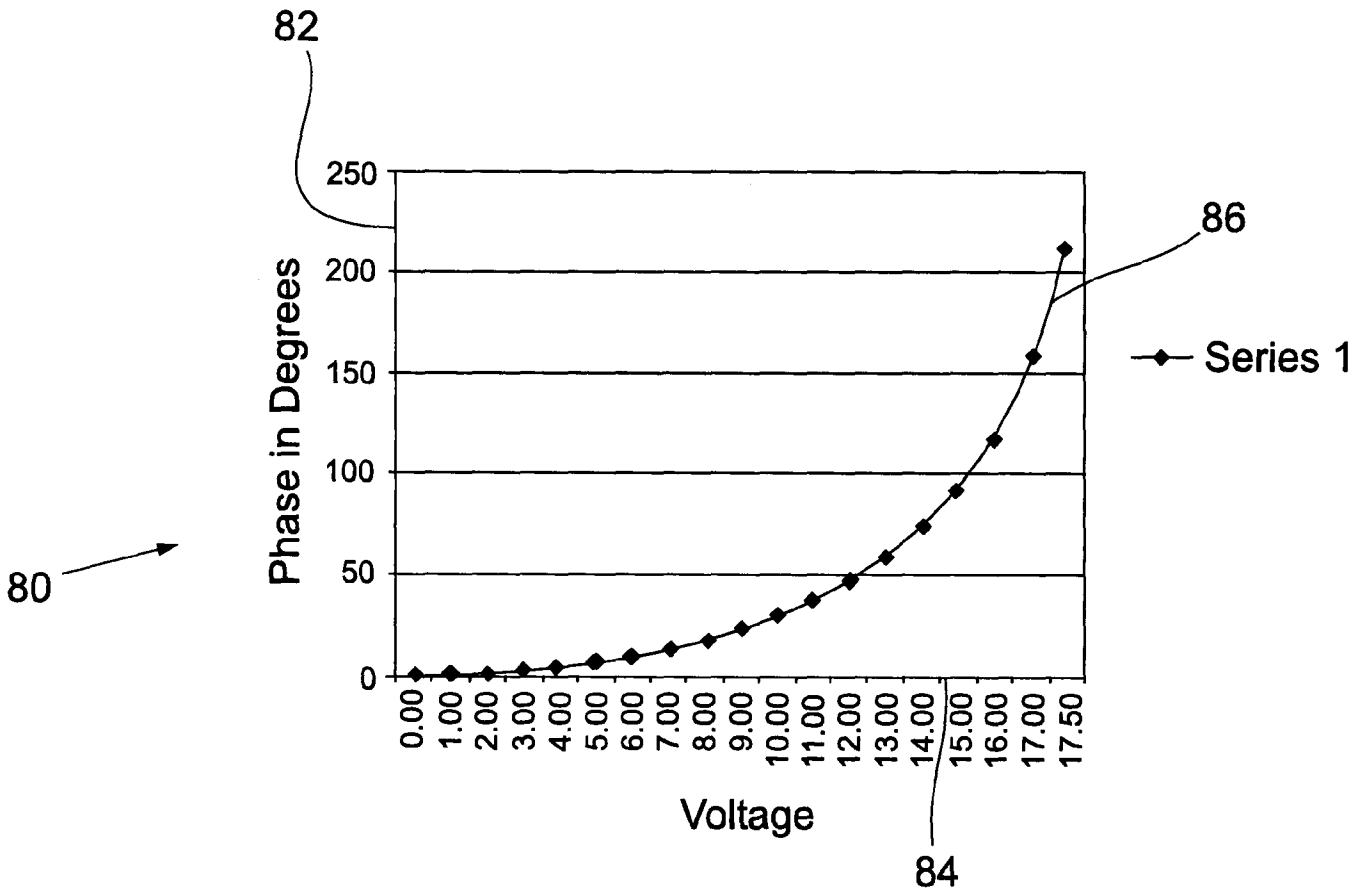
FIG. 6 is a graph which plots the phase against applied voltage for a device in accordance with the invention.

FIG. 6 is a graph 80 of phase 82 against applied voltage 84 for a device in accordance with the present invention. The curve 86 shows that the phase change is exponential in nature and controllable. In addition, at lower voltages the curve is approximately linear. In a preferred embodiment of the present invention, a phase shifter control is implemented using 5 such devices. In that case the cumulative effect allows a phase shift of up to 360° to be achieved with an applied voltage of between 0 V and 14 V.

The above device of the present invention provides a low power, low voltage actuated MEMS switch that changes the phase of a signal on a transmission line. Its use can be extended into a distributed MEMS transmission line (DTML) where each unit can be electrically controlled.

Figure 7A:
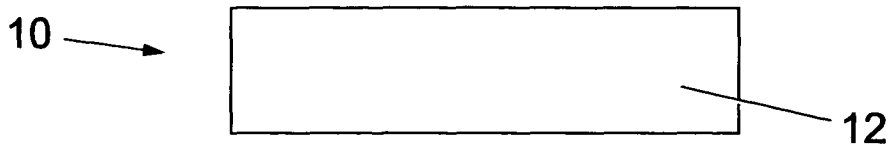
FIGS. 7*a* to 7*g* show a process for constructing an apparatus in accordance with the present invention.
Figure 7B:
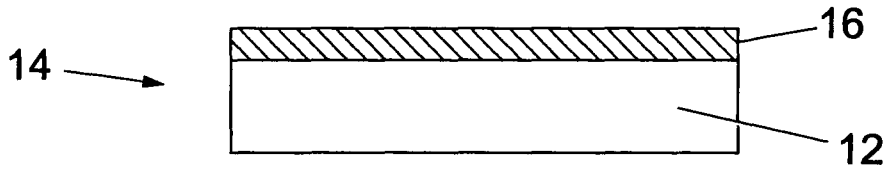
Figure 7C:
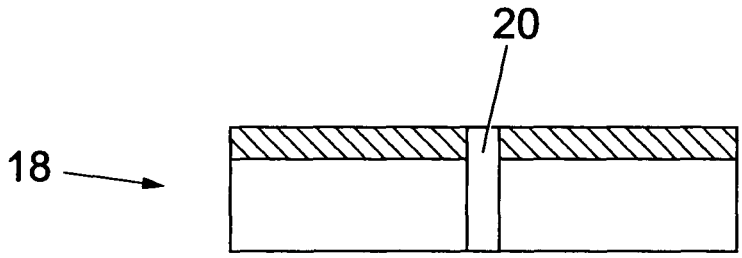
Figure 14:
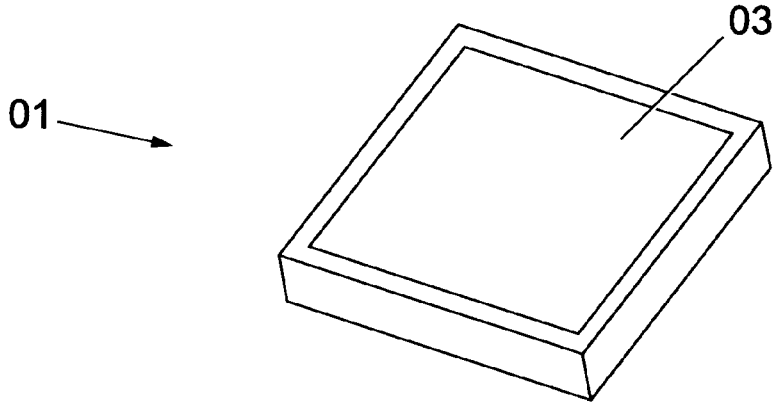
FIG. 14 shows a CMOS reconfigurable radio in accordance with the present invention.

FIGS. 7*a* to 7*g* show a process for making an apparatus in accordance with the present invention. FIG. 7*a*, shows an n type silicon semiconductor substrate 12. FIG. 7*b* 14 shows the n type silicon substrate 12 with an insulating layer 16. FIG. 7*c* shows the n type silicon substrate 12 with the insulator 16 and a thru hole or via into and through these layers.

Figure 7D:
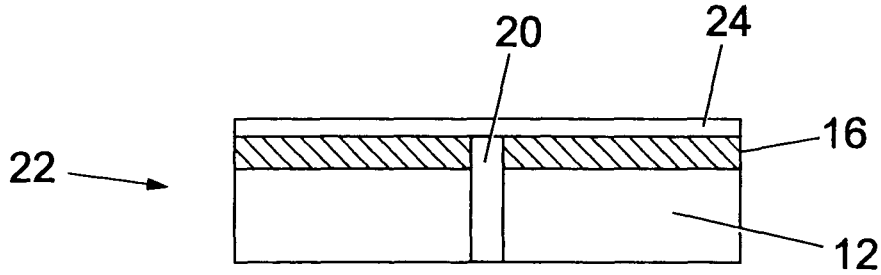
Figure 7E:
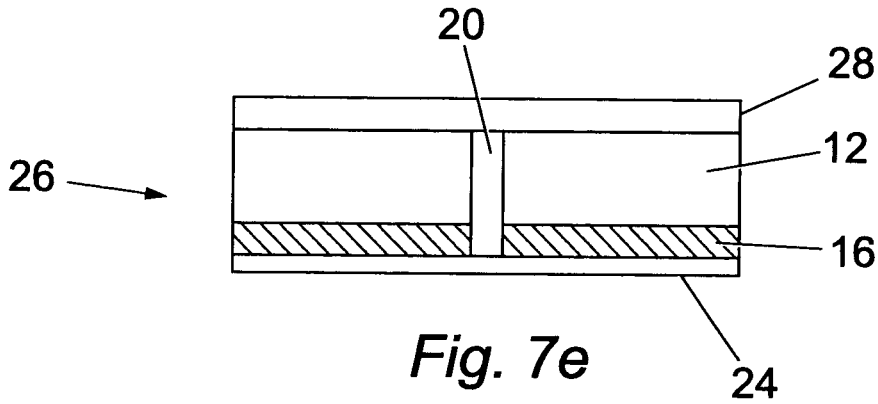
Figure 7F:
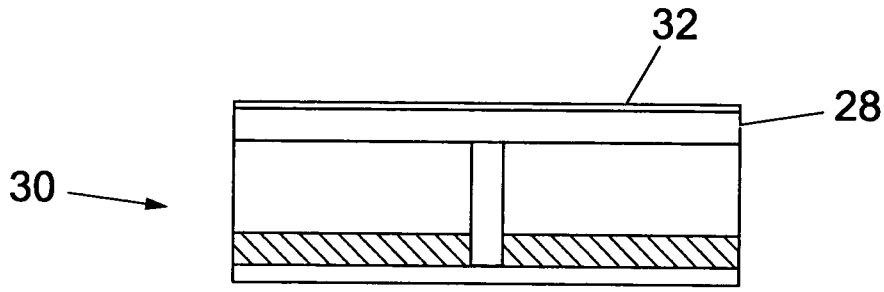
Figure 7G:
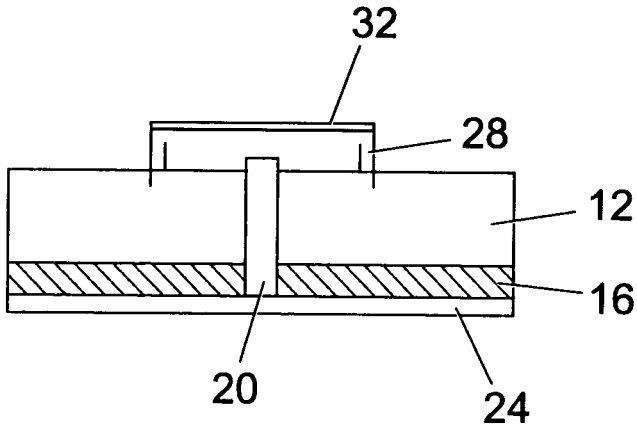

FIG. 7*d* shows the arrangement of FIG. 7*c* with a metal coating formed on top of the insulating layer. The metal coating 24 forms the antenna of the present invention. FIG. 7*e* shows the arrangement of FIG. 7*d* with an additional polymer layer 28 on the opposite surface of the silicon substrate to the antenna 24. FIG. 7*f* 30 shows a metal layer 32 deposited on top of the polymer layer 28. FIG. 7*g* shows the structure of the MEMS capacitive switch once it has been etched from the layered structure.

Figure 8:
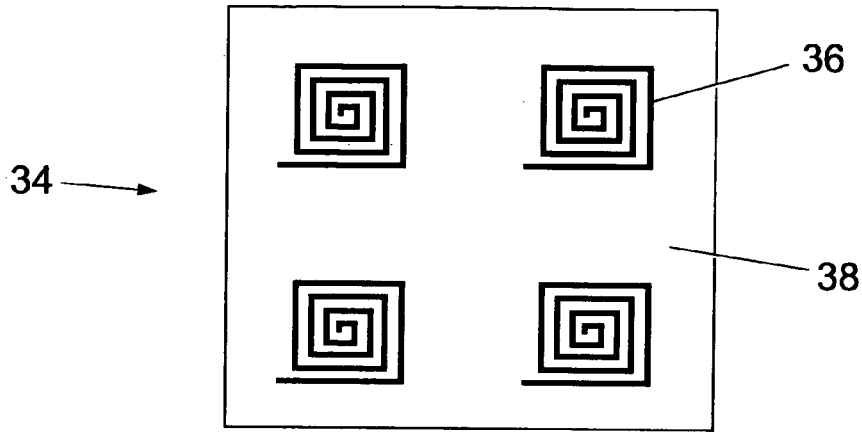
FIG. 8 shows a plurality of antenna mounted on a surface of an apparatus in accordance with the present invention.

FIG. 8 34 shows the surface of an apparatus in accordance with the present invention in which an antenna 36 has been shaped from the metal surface upon the substrate 38.

The numerous applications of electromagnetic transmission have necessitated the exploration and utilisation of most of the electromagnetic spectrum. In order to cover this whole range of frequencies, a further embodiment makes use of frequency independent antennas whose performance is invariant to their electrical properties, physical dimensions and the frequency of operation.

Such frequency independent antennas are completely specified by angle, and the requirement that the current attenuates along the structure until it is negligible at the point of truncation. For radiation and attenuation to occur, charge must be accelerated and this happens when a conductor is curved or bent normally to the direction in which the charge is travelling. Thus, the curvature of a spiral provides frequency independent operation over a wide bandwidth.

The advantage of this curved spiral design (not shown) is that an array of such frequency independent antennas can be used in conjunction with MEMS devices for beam forming. The overall radiation pattern of the beam can be steered in a desired direction. The MEMS devices are used to individually control the phase of the signal being fed to each antenna over the entire range of operating frequencies, giving the advantage not only of adapting the directivity of the radiation pattern, but simultaneously also the frequency of operation of the array. This close control of phase to each antenna within an array to simultaneously provide both frequency and directional adaptivity of the array is a novel feature of this embodiment.

Figure 9:
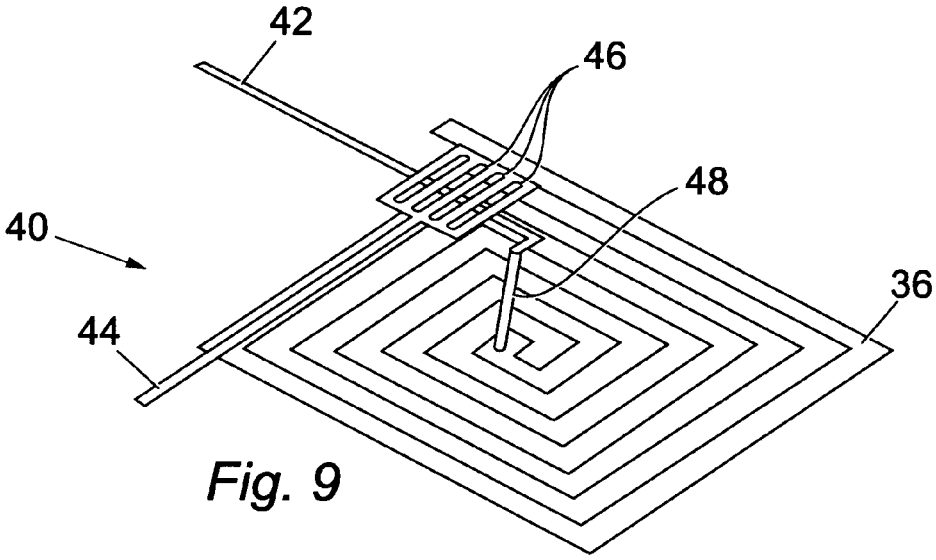
FIG. 9 shows the arrangement of antenna capacitive bridge MEMS switch and thru hole, in the absence of the supporting substrate.

FIG. 9 shows the arrangement of the present invention in the absence of the substrate. This view has been created in order to clarify certain features of the present invention. In this example, the antenna 36 is positioned on one side of the substrate (not shown) and is connected to the MEMS capacitor bridge 44 and to the transmission line 42 by means of a thru hole or via 48 which forms an electrically conducting path through the substrate from one side of the device to the other.

It is advantageous to create the apparatus of the present invention in this way in order to shield the MEMS switch from the electromagnetic radiation received or transmitted from the antenna.

In the prior art, it has been found that it is not possible to monolithically fabricate the MEMS and antenna on a semiconductor substrate. This is due to the high permittivity of the substrates and the surface waves that are formed in between the antenna and the ground plane. The present invention has the MEMS on the back side of the wafer and the antenna and the MEMS have a common ground. The antennas are designed to have very little back radiation. There is no surface current and very little electromagnetic field beyond the area behind the ground plane.

Figure 10:
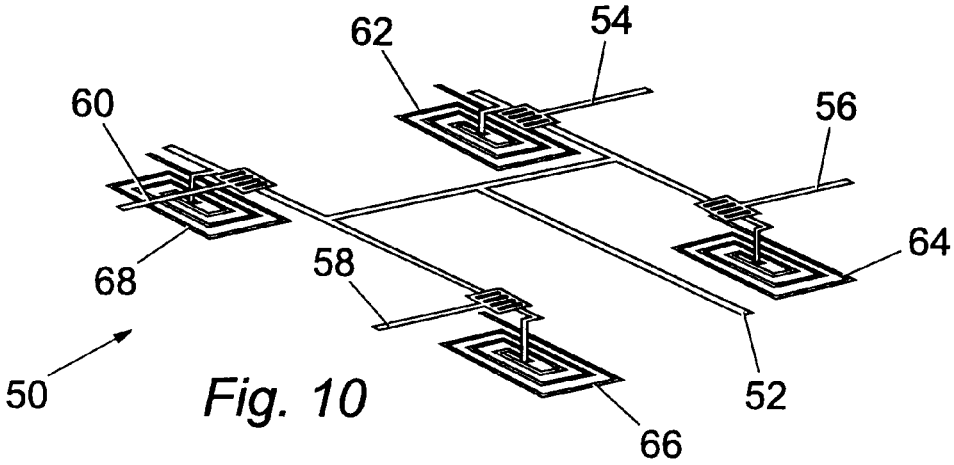
FIG. 10 shows a plurality of antenna and MEMS switches in the absence of the supporting substrate.

FIG. 10 is a further embodiment of the present invention in which four separate MEMS switches 54, 56, 58 and 60 are connected to four separate antenna 62, 64, 66 and 68. The transmission line 52 provides the input and output through the antenna. The MEMS switches 54, 56, 58 and 60 are controllable in order to switch each of the individual antenna 62, 64, 66 and 68 into or out from the transmission and or receipt of an electromagnetic signal. This is achieved by controlling the input to the MEMS switches in order to change the phase of the signal transmitted through to the antenna.

Figure 11:
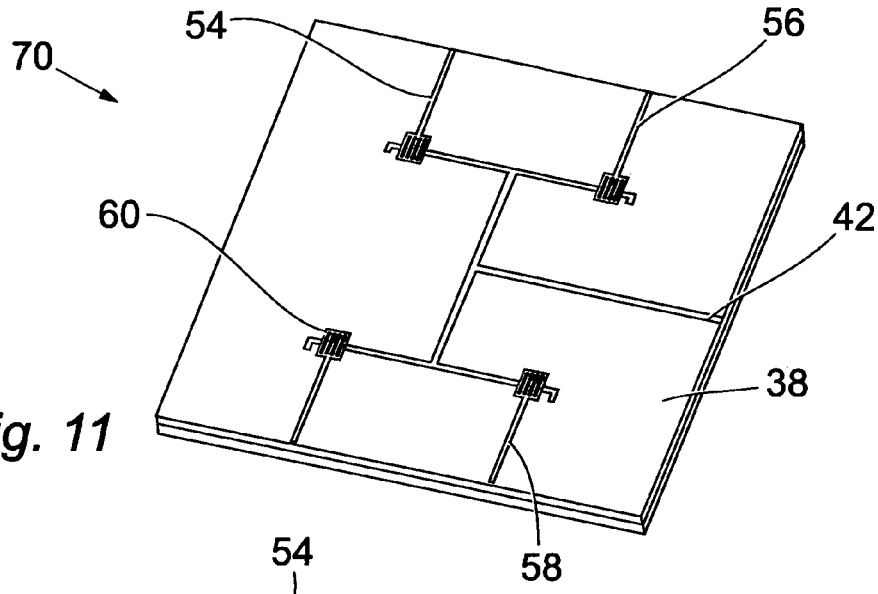
FIG. 11 shows the MEMS switches and the input/output track.
Figure 12:
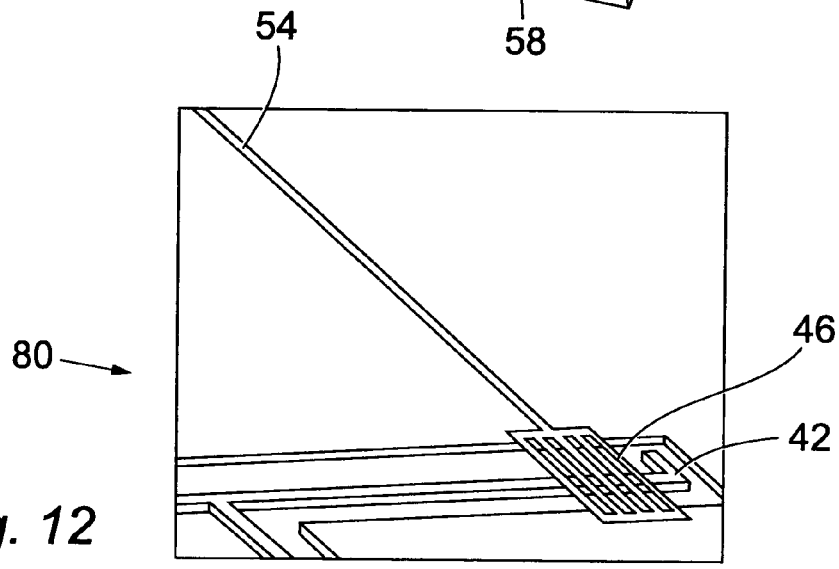
FIG. 12 is a perspective view of a MEMS switch bridge in accordance with the present invention.
Figure 13:
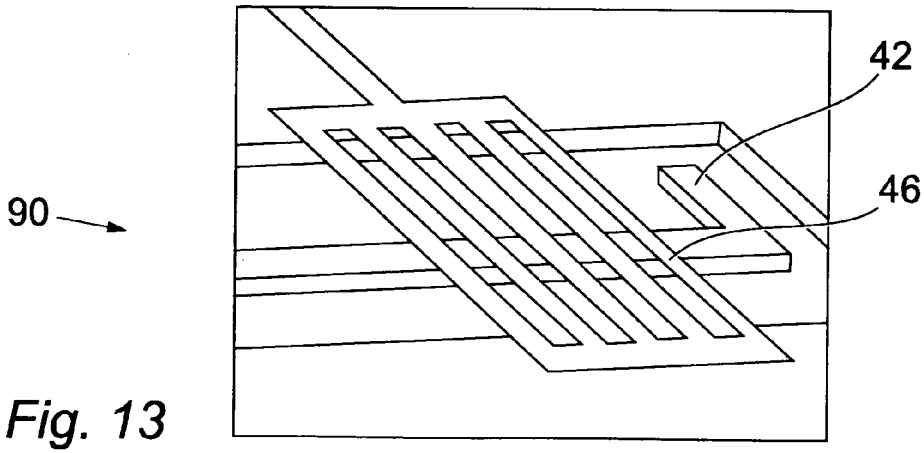
FIG. 13 is a more detailed view of the apparatus of FIG. 11.

FIGS. 11 to 13 show the device in varying degrees of detail. FIG. 11 shows simply each MEMS switch 54, 56, 58 and 60 connected to the transmission line 42 on one side of the substrate 38. FIG. 12 shows the bridge circuit 54 comprising a number of individual capacitive switches 46 connected to the transmission line 42. A more detailed view of FIG. 13, again, shows the capacitive switches 46 connected to the transmission line 42.

FIG. 14 shows a further embodiment of the present invention in which a CMOS reconfigurable radio chip is connected to the side of the substrate containing the MEMS switch.

Figure 15:
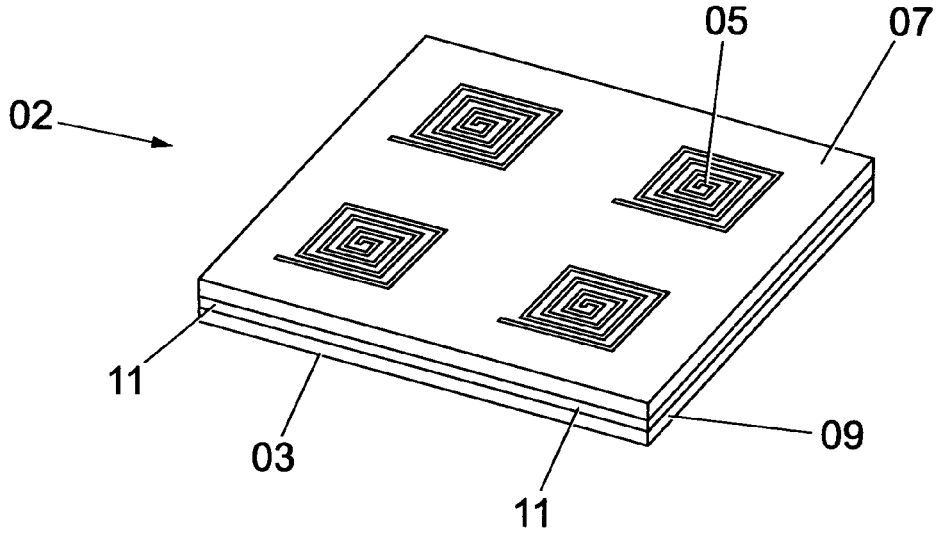
FIG. 15 is a perspective view of a CMOS configurable radio in accordance with the present invention.
Figure 16:
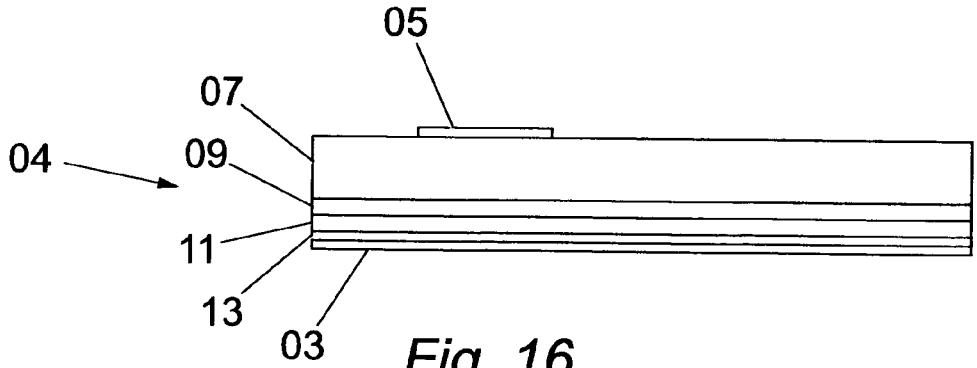
FIG. 16 is a side view of the reconfigurable radio of FIGS. 14 and 15 showing the various layers thereof.

FIG. 15 and FIG. 16 show the layered structure of this device. It comprises the CMOS radio 3 on one end surface and the antenna 05 on the other end surface. Between these surfaces there are a number of layers comprising an insulator layer 7, silicon layer 09, insulator 11 and a MEMS device 13.

The process of making a device in accordance with the present invention will be described with reference to FIGS. 7*a* to 7*g*.

An insulator material 16 is deposited on a high conductive silicon wafer 12 to a thickness of 200-500 um. The exact depth depends on the application of the antenna.

A thru hole 20 for the metallic probe is formed and then carefully freed from the substrate 12 to reveal the backside of the device. The backside is then electroplated with copper 24 to a thickness of 1 um and a probe of 20 um in diameter is formed. The copper 24 is masked with photo-resist and exposed to form the antenna of desired shape as shown in FIG. 8.

The MEMS structures 28, 32 are patterned and on the top layer. These MEMS devices play the role of a switch, phase shifter and matching circuit, making it a reconfigurable MEMS application device.

Therefore, a complete antenna or a large array of antennas can be incorporated on one side of the silicon wafer, whilst the MEMS devices are fabricated on the reverse side of the wafer. Having the MEMS on the other side reduces radiation interferences from the antennas and also simplifies the 3D integration of the RF and MEMS control circuits.

This adds a new dimension to the system on chip by having the reconfigurable antennas on the same chip with the RF and other modules. This reduces the losses and maximize the overall system efficiency and reduces power consumption, because of the short distance between the RF and the antenna feed. The present invention allows the integration of multiband antennas that have multi-frequency capabilities and a phased array network to make up a reconfigurable micro antenna array for multiband communication. The antenna arrays are reconfigurable in directivity, frequency, phase and polarisation.

Figure 17:
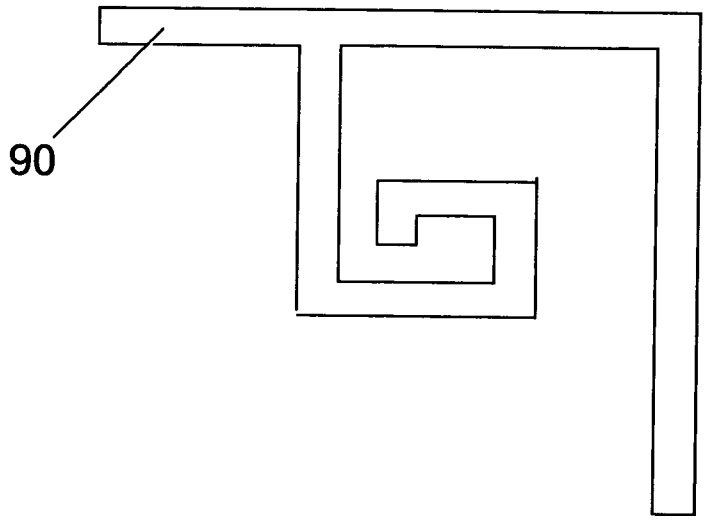
FIG. 17 shows a further antenna embodiment.

FIG. 17 shows a plan view of a further antenna embodiment 90 with the dimensions of the antenna. This embodiment has low power, operates well at multiple frequencies and has consistent performance over its range of operations.

Figure 18:
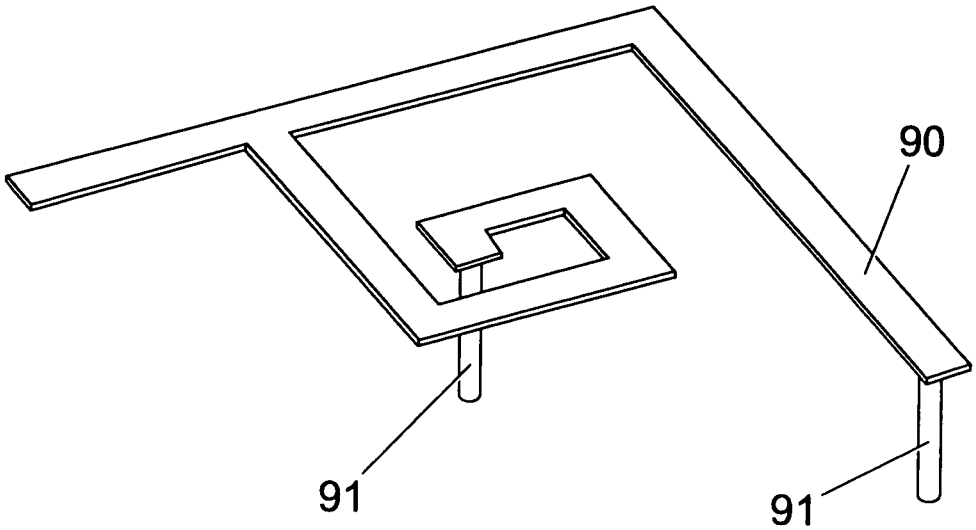
FIG. 18 shows a view of the antenna of FIG. 17 with the vias in the absence of the supporting substrate.

FIG. 18 shows a view of the antenna 90 of FIG. 17 with the vias 91 also shown in the absence of the supporting substrate.

Figure 19:
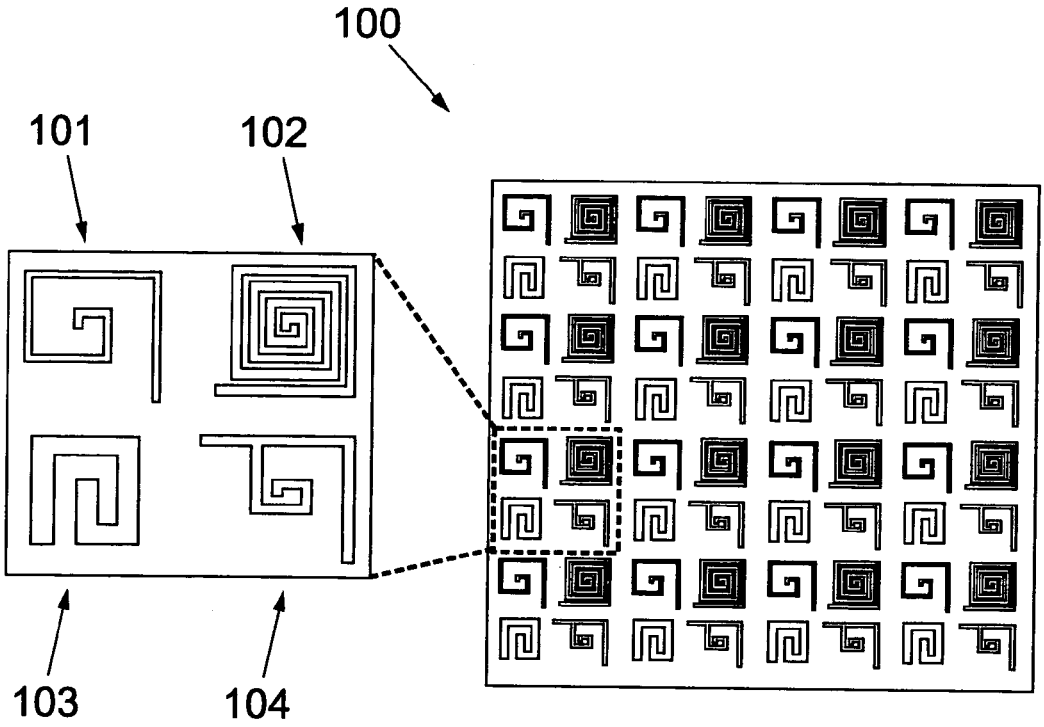
FIG. 19 shows an array of heterogeneous micro antennas with four types of antenna elements.

FIG. 19 shows an array 100 of heterogeneous micro antennas with four types of antenna elements 101, 102, 103 and 104 each having a different configuration. Not shown are the MEMS switches operable to switch on or off one or more of the antenna elements to configure the antenna array 100.

The reconfigurable antenna array 100 has an element group 101 to 104 repeated across the array 100. Also, an array of the elements 101 is interleaved with an array of the elements 102 across the larger array 100.

Homogeneous or heterogeneous antenna array structures may be implemented with an antenna size of less than 4 $mm^2$. The antenna arrays may include one, two, three, four or more different type of antennas (e.g. helical, spiral, . . . etc). The antenna array arrangement may cover all varieties of shapes and arrangement from a chess-like array structure, to larger arrays of repeated antenna cores. This allows smooth beam forming, and inclusive coverage to many frequency band and also allows from a single polarisation (vertical, horizontal, right circular and left circular) up to all possible polarisations in the same array.

Variations of the array shown in FIG. 19, which include combinations of the same pattern in different orientations, provides both right handed and left handed polarisations and an order of horizontal and vertical polarisations. The antenna arrays provide coverage for a large spectrum of frequencies, polarisations and space diversity.

Various antenna array structures are discussed below with reference to further figures.

Figure 20:
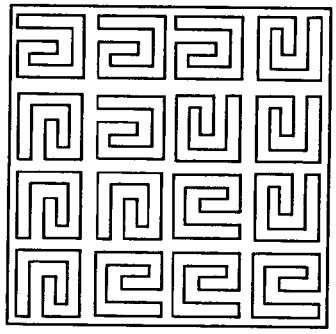
FIGS. 20 and 21 show examples of homogeneous arrays, with each element having the same shape, but transformed by rotation at different locations in the array.
Figure 21:
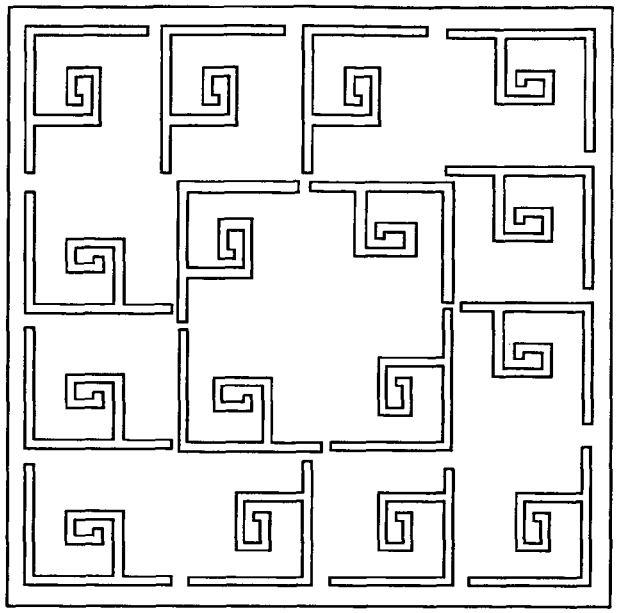

FIGS. 20 and 21 show examples of homogeneous arrays, with each element having the same shape, but transformed by rotation at different locations in the array.

Figure 22:
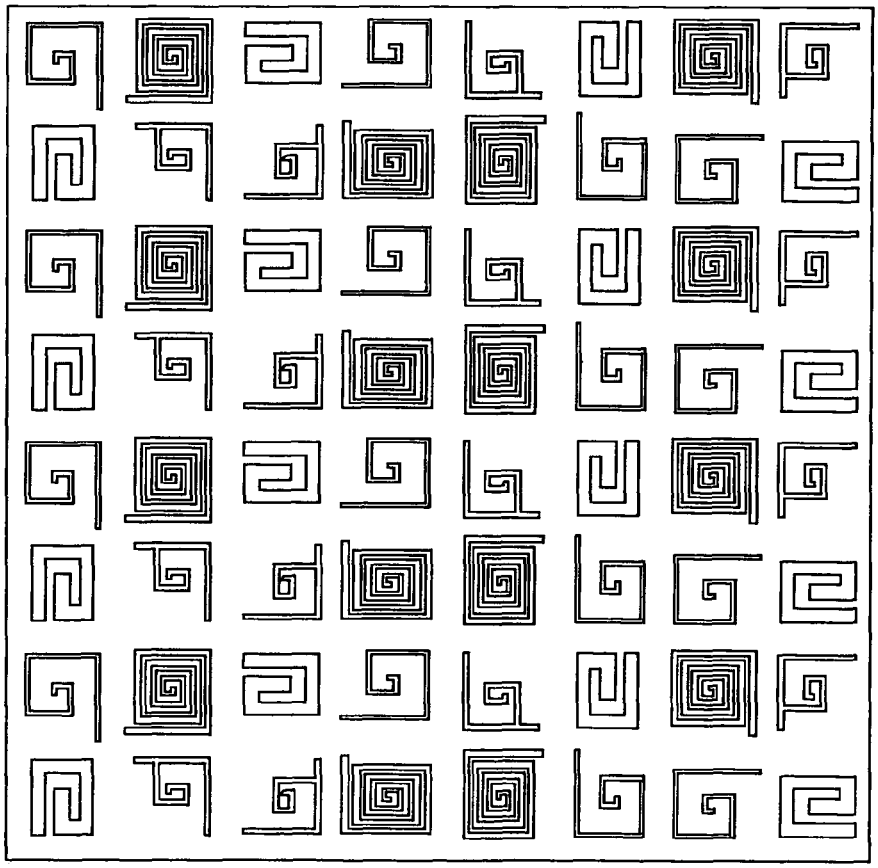
FIG. 22 shows an example of an heterogeneous array with four different types of antennas.

FIG. 22 shows an example of an heterogeneous array with four different types of antennas, similar to that shown in FIG. 19, but with each group being transformed by rotation as it is repeated horizontally across the array. The vertical repeat of each element group does not involve any transformation, just a translation, so each column comprises a stack of four identical groups for four.

Figure 23:
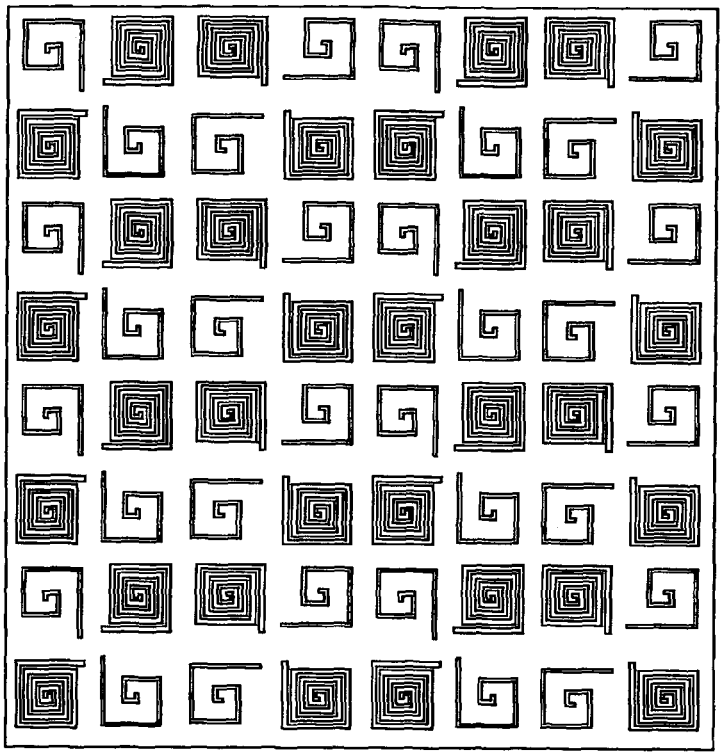
FIG. 23 shows an example of an heterogeneous array with two different types of antennas in repeated and rotated groups of four.

FIG. 23 shows an example of an heterogeneous array with two different types of antennas in a group of four. There are four rotations of each four-element group horizontally across the array. Again like FIG. 22, the vertical repeat of each element group does not involve any transformation, just a translation.

Figure 24:
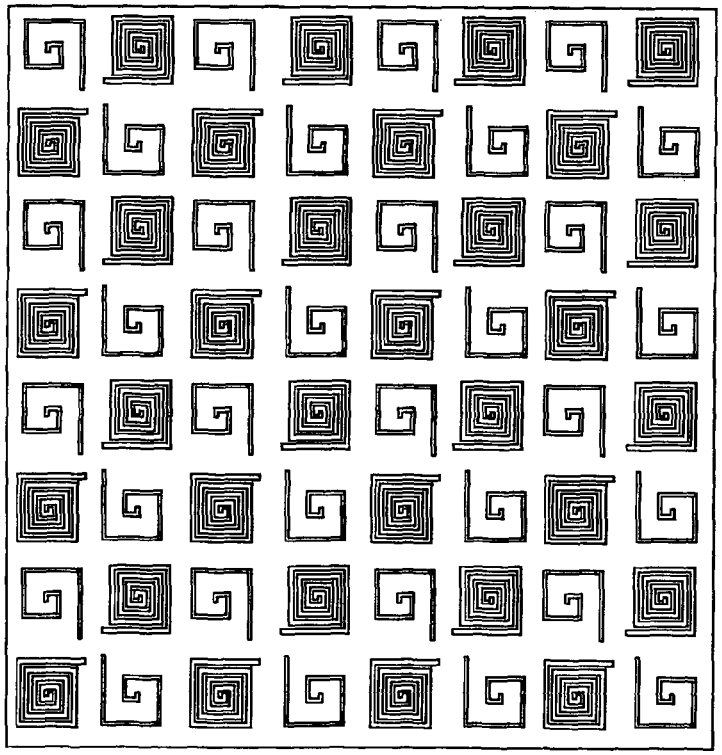
FIG. 24 shows an example of an heterogeneous array with two different types of antennas in repeated groups of four.

FIG. 24 shows an example of an heterogeneous array with two different types of antennas having no transformation of each four-element group across the array.

Figure 25:
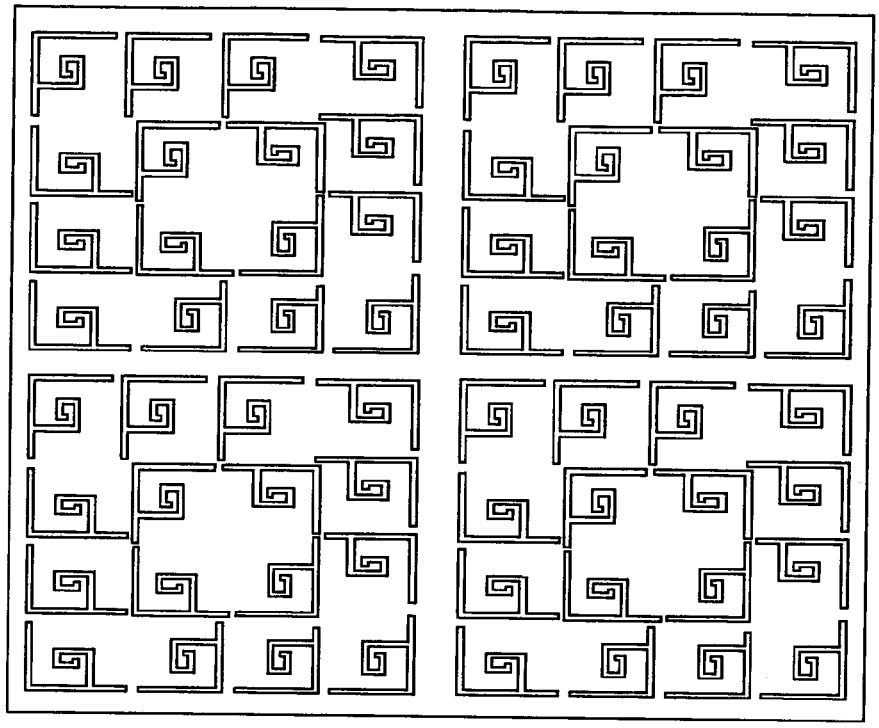
FIGS. 25 and 26 show examples of homogeneous and heterogeneous arrays respectively for providing multiple polarisations.

FIG. 25 shows an example of an homogeneous array for providing multiple polarisations, using different rotations of the base element of FIG. 17. Each quadrant of the antenna is identical to the other quadrants.

Figure 26:
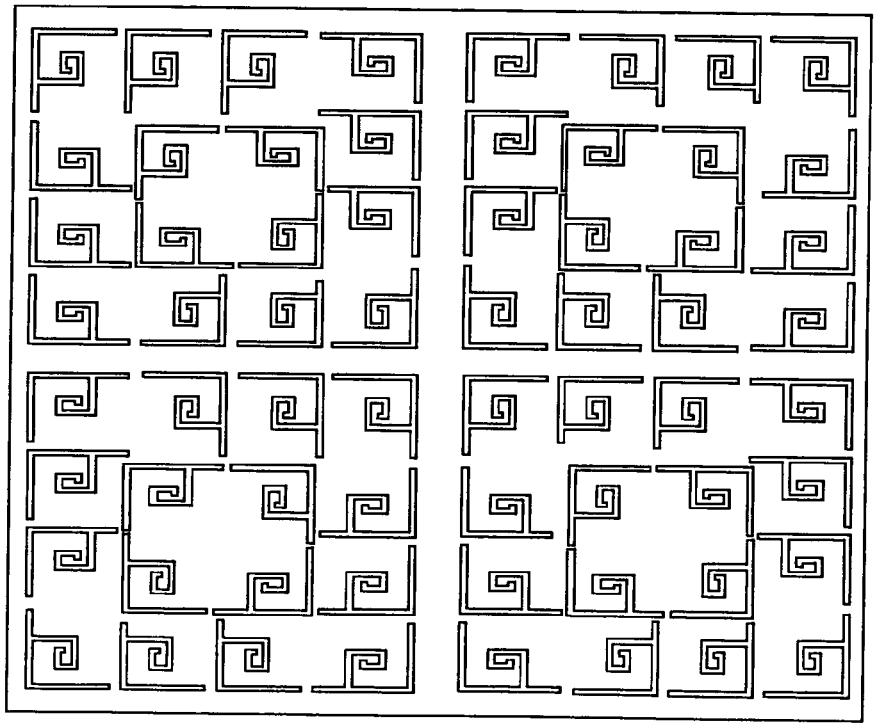

FIG. 26 shows an example of an heterogeneous array for providing multiple polarisations, using different rotations and reflections of the base element of FIG. 17. Each half of the antenna is reflected about the centre lines so each quadrant is a reflection of its nearest neighbour quadrant. Reflection of a spiral antenna element creates a different antenna type, so the array is heterogeneous.

Although transformation of antenna elements by rotation and reflection is shown in the Figures, other transformations, like scaling and distortion may also be used to provide different antenna element configurations.

Figure 27:
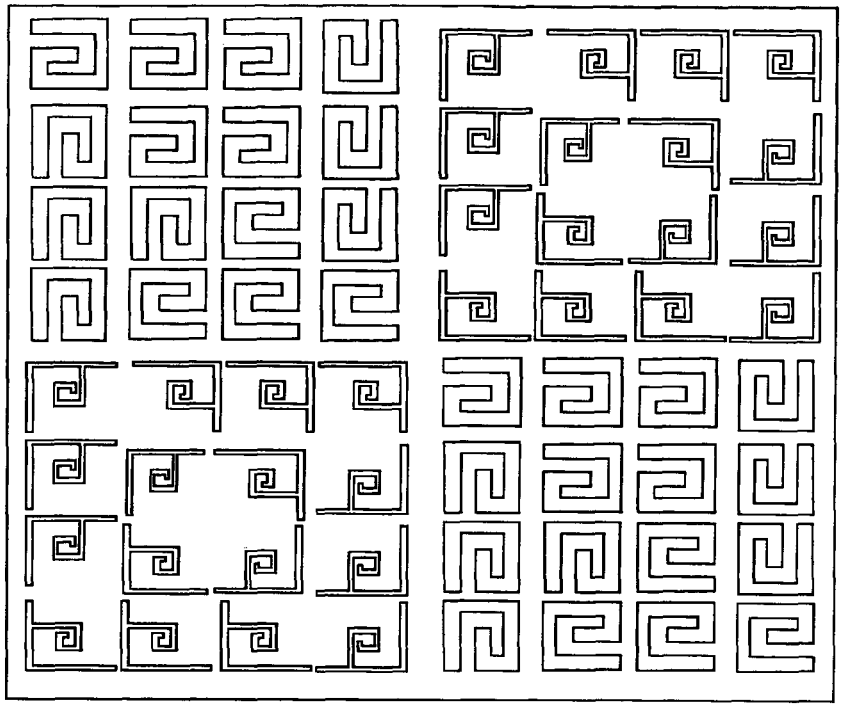
FIG. 27 shows an example of an heterogeneous array with a combination of homogenous arrays of different antenna designs.

FIG. 27 shows an example of an heterogeneous array with a combination of homogenous arrays of different antenna designs.

Figure 28:
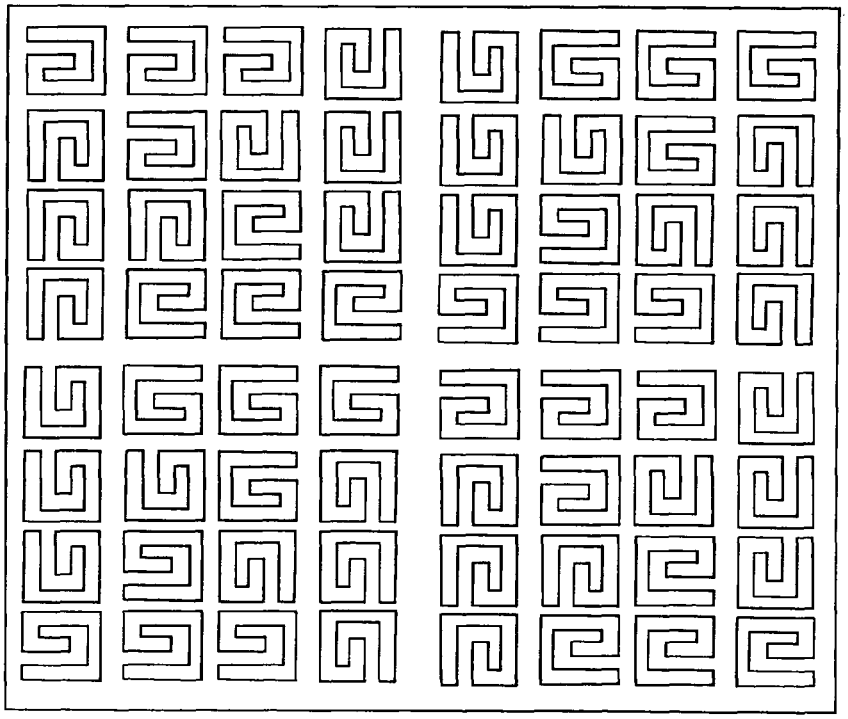
FIG. 28 shows an example of an heterogeneous array with a combination of homogenous arrays of similar antenna design.

FIG. 28 shows an example of an heterogeneous array with a combination of homogenous arrays of similar antenna design. Each half of the antenna is reflected about the centre lines so each quadrant is a reflection of its nearest neighbour quadrant.

Figure 29:
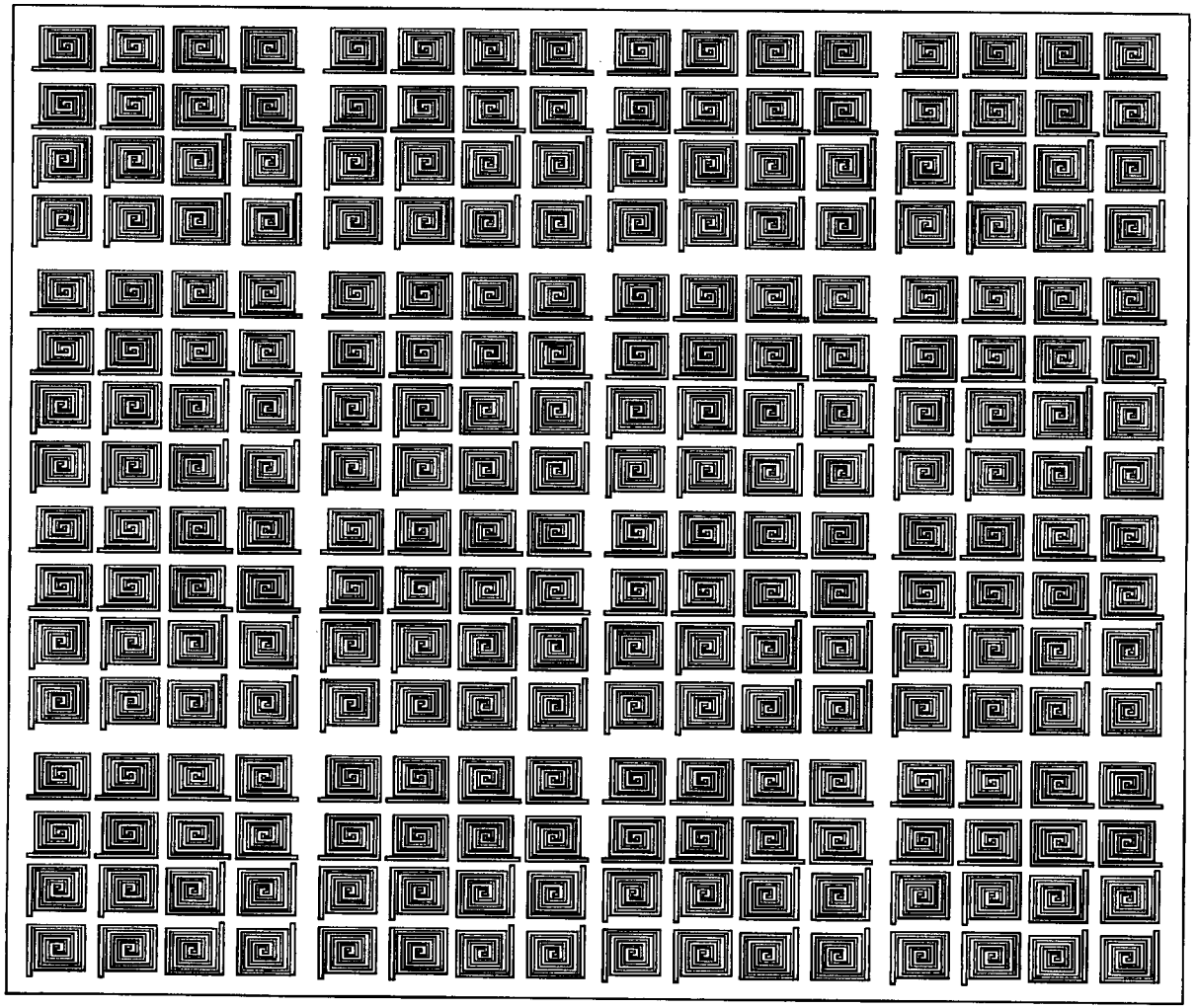
FIG. 29 shows an example of an heterogeneous array with a combination of homogenous arrays, having all possible polarisations.

FIG. 29 shows an example of an heterogeneous array with a combination of 4×4 homogenous arrays, having all possible polarisations. This is suitable for applications for larger array sizes, for example radar.

The antenna array of the present invention is used in order to simultaneously maximise the frequency spectrum coverage, also with high directivity, and multiple polarization capabilities. The array may comprises a number of dissimilar radiating elements that are placed in various orientations with respect to each other to minimise interference and maximise efficiency. The heterogeneous antenna arrays cater to a wider range of both civil and military applications.

The size of each element is in the order of millimeters and an array of such small antenna elements is not adversely restricted by size, thus allowing the possibility to use a large number of elements in the array. The structure of the array and the choice of its element types (heterogeneous & homogeneous), placement and their numbers are governed by the targeted application, the frequency range and polarisation required, the phase shifting needed, the power handling capacity of the feed system and packaging of the chip.

Generally, in antenna arrays there are inherent interference issues between the different array elements, however the array of the present invention has a capability to switch on/off individual elements to reduce the interference effects at any given frequency.

The placement of the elements in the array can provide various polarisations of the electromagnetic radiation; this can vary between horizontal, vertical, right circular and left circular polarisations. By appropriate placement of the array elements the array can achieve all kinds of polarisations on the same array.

The design may derive a single feed from the RF that is distributed amongst the radiating elements controlled via a network of MEMS phase shifters. This simplifies the RF end wherein the system will try and detect the maximum signal-to-noise ration (SNR) for the desired signal by varying the directivity of the beam.

With the application of reconfigurable MEMS, the idea of a miniature low power adaptive antenna is achievable and with a seamless reconfigurable SoC fabric we can build a number of applications on a single platform. Adaptive antenna arrays have an awareness of their environment and adjust automatically to their signal orientation to reduce interference and maximise desired signal reception.

The present invention can be used for multi-standard, multi frequency communications, to implement a single system for GSM at 900.1800 MHz, for 3G at 2 GHz, WLAN/Bluetooth at 2.4 GHz, for WLAN at 5 GHz and WiMAX 10-66 GHz. It is the user's demand to be able to make use of all these key communications systems, the present invention will let the user have the benefit of the complete spectrum on a single device.

Antennas being reciprocal devices have the same characteristics when transmitting and receiving microwaves, hence antennas which are used primarily for communications can also be applied for space based sensors. Passive microwave sensing is a similar concept to thermal sensing, which detects the naturally emitted microwave energy within its field of view. This emitted energy is related to the temperature and moisture properties of the emitting object or surface.

Automotive radar devices are now appearing on many transport and luxury passenger motor vehicles used in Europe and the United States of America (USA). These devices are employed in advanced cruise control systems, which can actuate a motor vehicle's accelerator and/or brakes to control its distance separation behind another vehicle. Examples of such systems are BMW's "Active Cruise Control", Jaguar's "Adaptive Cruise Control" and the Daimler-Benz "Distronic" system. It is anticipated that the use of these systems will become commonplace in the future.

A number of vehicle importers are seeking to bring cars with intelligent cruise control systems into Australia. The proposed systems employ pulsed radar devices operating within the frequency range 76-77 GHz. The European Conference of Postal and Telecommunications Administrations (CEPT) represents 43 European regulators. CEPT, through European Radio communications Committee (ERC) Decision (92)02 [2], decided that the 76-77 GHz band should be designated to vehicular radar systems on a non exclusive basis. Federal Communications Commission (FCC) [3] regulations supports the use of the frequency bands 46.7-46.9 GHz and 76.0-77.0 GHz within the USA for vehicle-mounted field disturbance sensors used as vehicle radar systems. International Telecommunication Union (ITU) Recommendation ITU R M.1310 [4] for the bands 60 61 GHz and 76-77 GHz to be use by automotive radar systems. Ministry of Post and Telecommunication (MPT) of Japan's application of the 60 61 GHz band and the 76-77 GHz band for this purpose which was similar to Asia-pacific Telecommunications Standardisation Program (ASTAP), which has approved a proposal on a draft standard on "Low Power Short-Range Vehicle Radar Equipment Operating in the 60-61 GHz, and 76-77 GHz bands".

Table 2 is a summary of the various frequency bands (by overseas organisation) in which the use of automotive radar is supported.

| Frequency Band(s) Supported | Organisation |
|---|---|
| 76-77 GHz | CEPT (Europe) |
| 76-77 GHz | ETSI (Europe) |
| 46.7-46.9 GHz, 76-77 GHz | FCC (USA) |
| 60-61 GHz, 76-77 GHz | ITU |
| 60-61 GHz, 76-77 GHz | MPT (Japan) |

Multi-mode radar (MMR) is the primary mission sensor for many military vehicles particularly aircrafts, it gives them the ability to track and scan multiple targets and meant to be low power, light weight and capable of broadband operation.

Employing reconfigurable antenna of the present invention in such an application is advantageous; it can be scaled into larger arrays to create multiple scan beams for the efficient operation in multimode radar. Since the dimensions of a single antenna is less than 4 $mm^2$ an array of such small MEMS antennas will give a low power, light weight device for such demanding applications.

A single 3" silicon wafer can integrate more than 200 elements of the current design (as shown below). Each sector of the larger antenna can operate at different modes for simultaneous track and scan of multiple targets as required by the application.

Due to the miniature size we can implement a heterogeneous array of antennas; each working at a number of frequencies. The array on the whole will cover the whole spectrum of frequencies. Hence on a single wafer implementation we can cover the frequencies of 1-150 GHz, providing broadband scan and narrow based tracking of targets. This would be ideal for military applications and tracking multiple targets by a single device.

Synthetic Aperture Radar (SAR) refers to a technique used to synthesize a very long antenna by combining signals (echoes) received by the radar as it moves along its flight track onboard a plane or a satellite. Aperture means the opening used to collect the reflected energy that is used to form an image.

SAR systems take advantage of the long-range propagation characteristics of radar signals and the complex information processing capability of modern digital electronics to provide high resolution imagery. Synthetic aperture radar complements photographic and other optical imaging capabilities because of the minimum constraints on time-of-day and atmospheric conditions and because of the unique responses of terrain and cultural targets to radar frequencies.

Synthetic aperture radar technology has provided terrain structural information to geologists for mineral exploration, oil spill boundaries on water to environmentalists, sea state and ice hazard maps to navigators, and reconnaissance and targeting information to military operations. There are many other applications or potential applications of the present invention. Some of these, particularly civilian, have not yet been adequately explored because lower cost electronics are just beginning to make SAR technology economical for smaller scale uses.

The present invention can cover the SAR frequencies using the various array structures described herein to produce a version of a SAR device that is low power, robust and miniaturised.

Applications of passive microwave remote sensing include meteorology, hydrology and oceanography. Most Earth observations satellites used today carry very specific radar subsystems which work according to a fixed band of the microwave spectrum. These are the P, L, S, C and X band which are well within the targeted range of our reconfigurable design.

There is currently an interest in military and civilian domains for body wearable antennas. The present invention provides reconfigurable antennas that are small and cover a large number of frequencies for high data rate microwave links and sensing. The design of the reconfigurable antenna for personal communication and sensing can be identified as a very useful application of the device.

The applications for such an adaptive antenna are not restricted to communications but also for medical treatment. Antennas used for Microwave Resonance Therapy (MRT), to generate high frequency microwaves, have successfully treated breast cancer in clinical trials; they have also been used for the biophysical treatment similar to acupuncture blending traditional eastern medicine to modern technology. In both cases phase array antennas are employed, due to the relative size, low power, costs of the design and the relative ease of integration with CMOS technology.

Improvements and modifications may be incorporated herein without deviating from the scope of the claims herein.

The invention claimed is:

1. An apparatus for transmitting and/or receiving electromagnetic waves, the apparatus comprising:

a substrate comprising a conductive semiconductor substrate;

an antenna fabricated on a first side of the substrate, wherein the antenna comprises a plurality of antenna elements;

a plurality of microelectromechanical (MEMS) switches fabricated on a reverse side of the substrate; and a plurality of connectors extending through the substrate to operatively connect the MEMS switches to the antenna, wherein the antenna and the plurality of microelectromechanical (MEMS) switches have a common ground, the common ground being the conductive semiconductor substrate that shields the MEMS switches from electromagnetic radiation received or transmitted from the antenna.

2. The apparatus of claim 1, wherein the substrate comprises a semiconductor layer and at least one insulating layer.

3. The apparatus of claim 2, wherein the at least one insulating layer forms a substrate for the antenna.

4. The apparatus of claim 1, wherein the antenna comprises a patterned metal surface.

5. The apparatus of claim 4, wherein the patterned metal surface comprises a spiral.

6. The apparatus of claim 5, wherein the spiral is curved.

7. The apparatus of claim 1, wherein the antenna elements are connected.

8. The apparatus of claim 1, wherein one or more of the antenna elements can be switched on or off.

9. The apparatus of claim 1, wherein one or more of the antenna elements can be switched on or off to control the operating frequency of the apparatus.

10. The apparatus of claim 1, wherein each MEMS switch is a capacitive switch.

11. The apparatus of claim 1, wherein each MEMS switch operates to change the phase of the input to or output from the antenna.

12. The apparatus of claim 1, wherein each MEMS switch comprises: a substrate; a first conducting layer; a material attached to the substrate wherein, the material acts as a mechanical support to the second conducting layer and as a dielectric.

13. The apparatus of claim 12, wherein the material is adapted to bend in response to the application of a force thereby changing the capacitance of the MEMS switch.

14. The apparatus of claim 12, wherein the material is adapted to bend in response to the application of a voltage across the first and second conducting layers thereby changing the capacitance of the MEMS switch.

15. The apparatus of claim 14, wherein the bridge structure comprises a beam shaped to alter the mechanical properties of the bridge and the way in which it moves in response to the applied voltage.

16. The apparatus of claim 15, wherein the beam is symmetrical.

17. The apparatus of claim 15, wherein the beam is asymmetrical.

18. The apparatus of claim 15, wherein the beam comprises a serpentine flexure.

19. The apparatus of claim 15, wherein the shape of the beam is configured such that it twists or bends in a predetermined manner upon the application of the voltage.

20. The apparatus of claim 15, wherein the MEMS switch is configured to connect and disconnect an electromagnetic device to a feed line or signal path.

21. The apparatus of claim 20, wherein the MEMS switch is used to alter the phase of the signal on the feed line.

22. The apparatus of claim 21, wherein the change in the phase with the applied voltage is substantially linear over a predetermined voltage range.

23. The apparatus of claim 21, wherein a plurality of the MEMS switches are combined to provide a controllable phase shift from 0 to 360° upon application of the applied voltage.

24. The apparatus of claim 12, wherein the material has a Young's Modulus of elasticity of less than 4.5 GPa.

25. The apparatus of claim 12, wherein the material has a dielectric constant at 1 MHz of more than 2.

26. The apparatus of claim 12, wherein the material is selected from the group consisting of a polymer, derived for para-xylylene, poly-monochoro-para-xylylene, and poly-para-xylylene.

27. The apparatus of claim 12, wherein the second conducting layer is a metal.

28. The apparatus of claim 12, wherein the second conducting layer comprises Aluminum.

29. The apparatus of claim 12, wherein the MEMS switch further comprises a co-planar waveguide mounted on the substrate.

30. The apparatus of claim 12, wherein the MEMS switch is integrated in a microstrip topology.

31. The apparatus of claim 1, wherein the connector is a through hole or via.

32. The apparatus of claim 1, wherein the apparatus further comprises an integrated circuit attached to the apparatus at or near the MEMS switch.

33. The apparatus of claim 32, wherein the integrated circuit comprises a CMOS circuit.

34. The apparatus of claim 33, wherein the CMOS circuit comprises a CMOS radio.

35. The apparatus of claim 1, wherein the plurality of antenna elements comprises an antenna array comprising a plurality of first antenna elements each having a first antenna configuration and further comprising a plurality of second antenna elements each having a second antenna configuration wherein first antenna configuration and second antenna configuration are different.

36. The apparatus of claim 35, wherein the second antenna configuration comprises a transformation of the first antenna configuration.

37. The apparatus of claim 36, wherein the transformation comprises at least one of rotation, reflection, scaling and distortion.

38. The apparatus of claim 35, wherein the plurality of first antenna elements is interleaved with the plurality of second antenna elements.

39. The apparatus of claim 35, wherein the antenna array comprises a first element group comprising the first and second antenna elements and a second element group comprising a transformation of the first element group.

40. The apparatus of claim 36, wherein the transformation comprises reflection.

41. The apparatus of claim 1, wherein the connector comprises conducting material attached thereto.

42. An apparatus for transmitting and/or receiving electromagnetic waves, the apparatus comprising:

a substrate;

an antenna fabricated on a first side of the substrate, wherein the antenna comprises a plurality of antenna elements;

a plurality of microelectromechanical (MEMS) switches fabricated on a reverse side of the substrate; and a plurality of connectors extending through the substrate to operatively connect the MEMS switches to the antenna, wherein the substrate comprises a conductive semiconductor substrate to shield the MEMS switches from electromagnetic radiation received or transmitted from the antenna and wherein the antenna and plurality of microelectromechanical (MEMS) switches are monolithically fabricated on the conductive semiconductor substrate.

43. The apparatus of claim 42, wherein the MEMS switches and the antenna have a common ground.

44. The apparatus of claim 43, wherein the common ground comprises the conductive semiconductor substrate.

45. The apparatus of claim 42, wherein each MEMS switch comprises: a substrate; a first conducting layer; a material attached to the substrate wherein, the material acts as a mechanical support to the second conducting layer and as a dielectric, and wherein the MEMS switch is operable to alter the phase of a signal on a feed line or signal path.

46. The apparatus of claim 42, wherein the plurality of antenna elements comprises an antenna array comprising a plurality of first antenna elements each having a first antenna configuration and further comprising a plurality of second antenna elements each having a second antenna configuration wherein first antenna configuration and second antenna configuration are different.

* * * * *